US010497245B1

(12) United States Patent
Hatch

(10) Patent No.: US 10,497,245 B1
(45) Date of Patent: Dec. 3, 2019

(54) CHILD MONITORING BRACELET/ANKLET

(71) Applicant: Vivint, Inc., Provo, UT (US)

(72) Inventor: Brandon Hatch, Provo, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 15/656,754

(22) Filed: Jul. 21, 2017

Related U.S. Application Data

(63) Continuation of application No. 14/298,377, filed on Jun. 6, 2014, now Pat. No. 9,721,445.

(51) Int. Cl.
*G08B 21/02* (2006.01)
*G07C 9/00* (2006.01)

(52) U.S. Cl.
CPC ..... *G08B 21/0261* (2013.01); *G08B 21/0255* (2013.01); *G07C 9/00111* (2013.01)

(58) Field of Classification Search
CPC ..... G08B 21/0261; G08B 21/0255; G07C 9/00111
See application file for complete search history.

(56) References Cited

U.S. PATENT DOCUMENTS 5,204,670 A * 4/1993 Stinton ..... A61B 5/0531 340/10.5
5,266,944 A * 11/1993 Carroll ..... G07C 9/00111 340/10.42
5,309,144 A * 5/1994 Lacombe ..... G08B 25/008 340/502
6,049,598 A * 4/2000 Peters ..... H04M 11/025 348/14.05
6,300,872 B1 * 10/2001 Mathias ..... G07C 9/00111 340/5.2
6,492,906 B1 * 12/2002 Richards ..... G01S 13/42 340/573.1
6,639,516 B1 * 10/2003 Copley ..... G08B 21/0283 340/426.17
6,720,874 B2 * 4/2004 Fufido ..... G07C 9/00031 340/5.2
6,937,154 B2 * 8/2005 Zeps ..... G06F 21/554 340/539.1
6,987,451 B2 * 1/2006 McKeown ..... G07C 9/00111 340/539.25
6,998,987 B2 * 2/2006 Lin ..... G08B 13/19608 340/573.1
7,102,509 B1 * 9/2006 Anders ..... G06Q 10/08 340/5.2
7,330,123 B1 * 2/2008 Grahn ..... G08B 21/082 340/553
7,388,488 B2 * 6/2008 Lupoli ..... G06Q 10/08 340/572.1
7,397,363 B2 * 7/2008 Joao ..... B60R 25/102 340/539.11
7,466,224 B2 * 12/2008 Ward ..... G07C 9/00111 340/5.2

(Continued)

*Primary Examiner* — Joseph H Feild
*Assistant Examiner* — Rufus C Point
(74) *Attorney, Agent, or Firm* — Holland & Hart, LLP

(57) ABSTRACT

Methods and systems are described for tracking location using a home automation system. One method includes receiving sensor data indicating presence of a wearable tracking device in a predetermined area of a property monitored by the home automation system, confirming an identity of the tracking device, and generating a notice indicating a location of the tracking device.

20 Claims, 10 Drawing Sheets

(56) References Cited

U.S. PATENT DOCUMENTS 7,796,029 B2 * 9/2010 Ma ..... G07C 9/00111 340/5.81
7,978,085 B1 * 7/2011 Kearns ..... G06F 19/00 340/573.4
8,035,479 B2 * 10/2011 Tran ..... G07C 9/00309 340/5.71
8,102,238 B2 * 1/2012 Golander ..... G07C 9/00111 235/375
8,120,459 B2 * 2/2012 Kwak ..... H04L 12/64 340/5.2
8,350,694 B1 * 1/2013 Trundle ..... G08B 25/08 340/539.11
8,564,661 B2 * 10/2013 Lipton ..... G08B 13/19608 348/143
8,917,939 B2 * 12/2014 Clarke ..... G06K 9/00523 382/198
8,959,082 B2 * 2/2015 Davis ..... G06F 16/00 707/723
8,988,215 B1 * 3/2015 Trundle ..... G08B 25/08 340/539.11
9,036,028 B2 * 5/2015 Buehler ..... G08B 13/19602 348/159
9,378,601 B2 * 6/2016 Ricci ..... B60Q 1/00
9,697,656 B2 * 7/2017 Trani ..... G07C 9/00007
9,865,144 B2 * 1/2018 Trani ..... G08B 13/19695
2001/0052851 A1 * 12/2001 Mathias ..... G07C 9/00111 340/573.1
2003/0043040 A1 * 3/2003 Zeps ..... G06F 21/554 340/573.1
2003/0043041 A1 * 3/2003 Zeps ..... G06F 21/554 340/573.1
2003/0210139 A1 * 11/2003 Brooks ..... B64F 1/368 340/531
2004/0143737 A1 * 7/2004 Teicher ..... G06K 7/1095 713/167
2005/0122397 A1 * 6/2005 Henson ..... H04N 7/181 348/143
2005/0128293 A1 * 6/2005 Wilsey ..... G06K 7/10079 348/143
2005/0148828 A1 * 7/2005 Lindsay ..... A61B 5/00 600/300
2005/0270158 A1 * 12/2005 Corbett, Jr. ..... G08B 21/0261 340/572.1
2005/0285941 A1 * 12/2005 Haigh ..... G08B 13/19602 348/155
2006/0004580 A1 * 1/2006 Claudatos ..... G08B 13/1672 704/275
2006/0004582 A1 * 1/2006 Claudatos ..... G08B 13/1672 704/275
2006/0187034 A1 * 8/2006 Styers ..... G05B 9/02 340/545.1
2006/0190974 A1 * 8/2006 Lee ..... H04N 7/163 725/87
2006/0240824 A1 * 10/2006 Henderson ..... H04L 51/04 455/435.1
2007/0086626 A1 * 4/2007 Mariani ..... G06K 9/00228 382/115
2007/0182818 A1 * 8/2007 Buehler ..... G08B 13/19602 348/143
2007/0252001 A1 * 11/2007 Kail ..... G07C 9/00087 235/380
2008/0074262 A1 * 3/2008 Paulkovich ..... G06Q 10/087 340/572.1
2008/0117299 A1 * 5/2008 Carter ..... H04M 11/025 348/152
2008/0129489 A1 * 6/2008 Fujimoto ..... G08B 13/1427 340/539.13
2008/0248778 A1 * 10/2008 Boss ..... H04M 11/04 455/404.1
2009/0002155 A1 * 1/2009 Ma ..... G07C 9/00111 340/539.25
2009/0021381 A1 * 1/2009 Kondo ..... G08B 21/0275 340/573.1
2009/0051767 A1 * 2/2009 Iwamura ..... G08B 13/19656 348/143
2009/0189758 A1 * 7/2009 Liu ..... G08B 13/19621 340/539.11
2009/0295534 A1 * 12/2009 Golander ..... G07C 9/00111 340/5.2
2009/0300174 A1 * 12/2009 Floris ..... G06Q 10/06 709/224
2010/0033575 A1 * 2/2010 Lee ..... G08B 13/19656 348/159
2010/0102929 A1 * 4/2010 Haumann ..... G01S 5/02 340/5.81
2010/0141437 A1 * 6/2010 Karam ..... G08B 25/10 340/539.23
2011/0081052 A1 * 4/2011 Bigioi ..... G06K 9/00261 382/118
2011/0205358 A1 * 8/2011 Aota ..... G01S 19/23 348/143
2012/0077463 A1 * 3/2012 Robbins ..... H04M 3/42374 455/411
2012/0077493 A1 * 3/2012 Robbins ..... H04W 4/021 455/435.1
2012/0105193 A1 * 5/2012 Gritti ..... G08B 13/00 340/3.4
2012/0136217 A1 * 5/2012 Cheung Hyen ..... A61B 5/0002 600/300
2012/0223834 A1 * 9/2012 Hyatt ..... G08B 21/0247 340/539.13
2012/0286929 A1 * 11/2012 Kline ..... G06F 21/35 340/5.81
2012/0300067 A1 * 11/2012 Naqvi ..... G01V 3/12 348/143
2012/0302226 A1 * 11/2012 Jesudason ..... H04W 52/0229 455/420
2012/0322380 A1 * 12/2012 Nannarone ..... G08B 13/1427 455/41.2
2013/0183924 A1 * 7/2013 Saigh ..... H04W 4/029 455/404.2
2013/0214902 A1 * 8/2013 Pineau ..... H04W 4/90 340/5.61
2013/0297217 A1 * 11/2013 Bangera ..... G16H 50/30 702/19
2013/0328678 A1 * 12/2013 Shechter ..... G08B 21/0236 340/539.13
2014/0015978 A1 * 1/2014 Smith ..... G07B 15/02 348/156
2014/0067130 A1 * 3/2014 Pillai ..... H04L 12/2816 700/275
2014/0171114 A1 * 6/2014 Marti ..... G01C 21/10 455/456.2
2014/0233855 A1 * 8/2014 Clarke ..... G06K 9/00523 382/190
2014/0253285 A1 * 9/2014 Menzel ..... G07C 9/00023 340/5.7
2014/0309789 A1 * 10/2014 Ricci ..... B60Q 1/00 700/276
2014/0354429 A1 * 12/2014 Henderson ..... G08B 21/22 340/541
2015/0006263 A1 * 1/2015 Heier ..... G06Q 10/06398 705/7.42
2015/0025790 A1 * 1/2015 Hwang ..... H04W 4/90 701/411
2015/0085111 A1 * 3/2015 Lavery ..... H04N 21/21805 348/143
2015/0095418 A1 * 4/2015 Davis ..... H04L 67/306 709/204
2015/0142141 A1 * 5/2015 Okabayashi ..... G08C 17/02 700/83
2015/0177939 A1 * 6/2015 Anderson ..... G06F 21/35 715/745
2015/0230022 A1 * 8/2015 Sakai ..... H04R 1/1041 381/58
2015/0280937 A1 * 10/2015 Sadhu ..... H04W 4/44 709/217

(56) References Cited

U.S. PATENT DOCUMENTS

2015/0287296 A1* 10/2015 Hall ..... H04W 4/029
340/541
2015/0302769 A1* 10/2015 Johnson ..... G09B 19/0076
434/308
2015/0309483 A1* 10/2015 Lyman ..... G05B 15/02
700/275
2015/0309484 A1* 10/2015 Lyman ..... G05B 13/0205
700/275
2015/0309487 A1* 10/2015 Lyman ..... H04L 12/2827
700/275
2015/0323915 A1* 11/2015 Warren ..... G05B 15/02
700/275
2016/0055692 A1* 2/2016 Trani ..... G07C 9/00007
340/5.61
2016/0343163 A1* 11/2016 Venkatesha ..... G06T 19/006
2018/0077546 A1* 3/2018 Arunachalam ..... H04W 4/80

* cited by examiner

CHILD MONITORING BRACELET/ANKLET

CROSS-REFERENCE TO RELATED APPLICATIONS

This application is a continuation application of U.S. patent application Ser. No. 14/298,377 entitled "CHILD MONITORING BRACELET/ANKLET," which was filed Jun. 6, 2014, which is incorporated by reference herein.

BACKGROUND

Advancements in media delivery systems and media-related technologies continue to increase at a rapid pace. Increasing demand for media has influenced the advances made to media-related technologies. Computer systems have increasingly become an integral part of the media-related technologies. Computer systems may be used to carry out several media-related functions. The wide-spread access to media has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the wide-spread use of computers and mobile devices has come an increased presence of home automation and security products. Advancements in mobile devices allow users to monitor and/or control an aspect of a home or business. As home automation and security products expand to encompass other systems and functionality in the home, opportunities exist for tracking occupants of a property being monitored by home automation and security products.

SUMMARY

Methods and systems are described for tracking location using a home automation system. The method includes receiving sensor data indicating presence of a wearable tracking device in a predetermined area of a property monitored by the home automation system, confirming an identity of the tracking device, and generating a notice indicating a location of the tracking device.

In one example, the method further includes generating suggested actions to be taken in response to the location of the tracking device. Confirming the identity of the tracking device may include taking a picture or generating video content of at least one of the tracking device, a person wearing the tracking device, and at least a portion of the predetermined area. Confirming the identity of the tracking device may include comparing an identification code for the tracking device to a database of identification codes associated with occupants of the property. The home automation system may include at least one proximity sensor positioned in the predetermined area, and receiving sensor data may include receiving sensor data from the at least one proximity sensor. The at least one proximity sensor may be a radio frequency sensor. The method may include transmitting the notice to a remote computing device.

The method may include receiving instructions from the remote computing device and performing at least one action related to the home automation system in response to the instructions. The property may include a plurality of predetermined areas, and the method may further include assigning a priority level to each of the plurality of predetermined areas, wherein the notice is dependent at least in part on the assigned priority level. The tracking device may include a wrist band or anklet wearable by one of a person and a pet. The method may include receiving sensor data indicating presence of another wearable tracking device in the predetermined area, confirming an identity of the another tracking device, and terminating the notice based on the confirmed identity of the another tracking device.

According to another embodiment, an apparatus for tracking location using a home automation system includes a processor, a memory in electronic communication with the processor, and instructions stored in the memory which are executable by a processor to receive sensor data from a short wave sensor indicating presence of a wearable tracking device in a predetermined area of a property monitored by the home automation system, and generate a notice indicating a location of the tracking device.

In one example, the instructions may be executable by the processor to confirm an identity of a person wearing the tracking device. Generating the notice may include generating an audible message. Generating the notice may include transmitting a message to a mobile computing device. The instructions may be executable by the processor to operate a feature of the home automation system to limit access to the predetermined area in response to the notice.

Another embodiment is directed to a computer-program product for tracking location using a home automation system. The computer-program product includes a non-transitory computer-readable medium storing instructions executable by a processor to receive sensor data indicating presence of a wearable tracking device in a predetermined area of a property monitored by the home automation system, determine an identity of a person wearing the tracking device, generate a notice indicating a location of the tracking device, and transmit the notice to at least one supervisor of the person.

In one example, determining the identity of the person may include monitoring video content from at least one camera having a viewing area of the predetermined area. The instructions may be executable by the processor to transmit the notice to the person wearing the tracking device. Determining the identity of the person may include searching a database for information about the person associated with the wearable tracking device.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
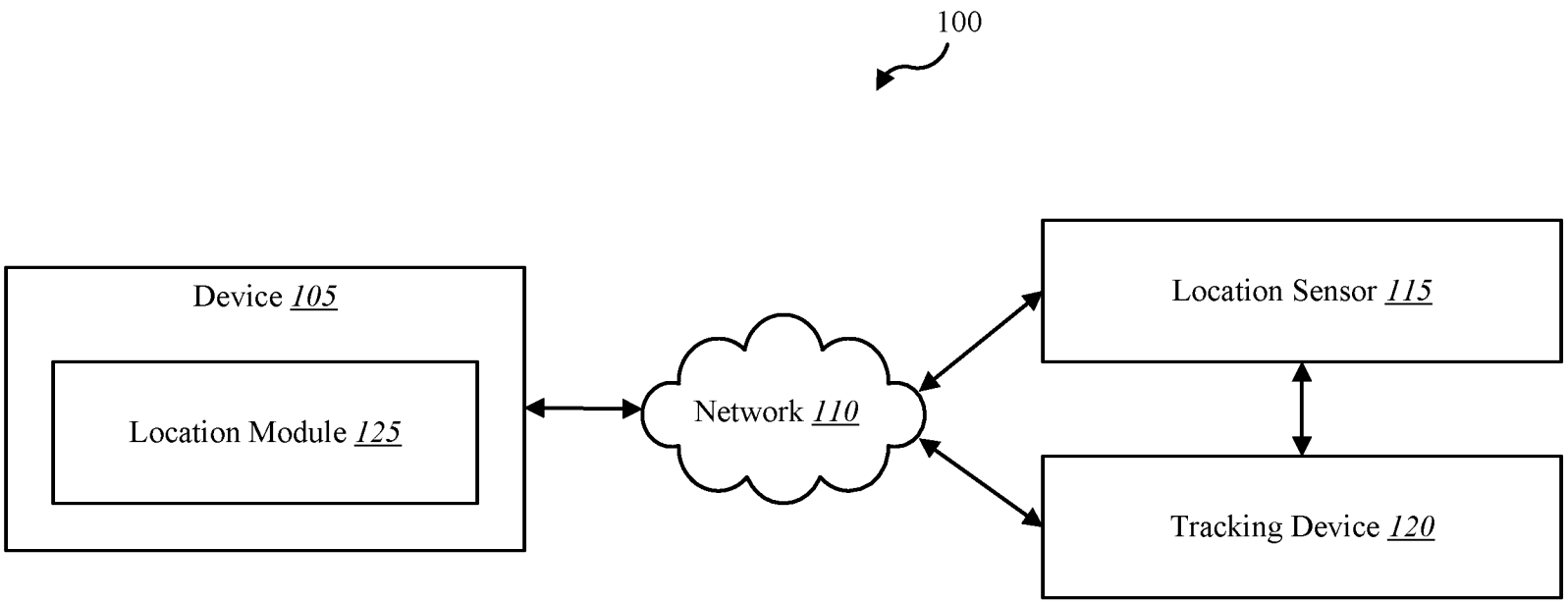
FIG. 1 is a block diagram of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The systems and methods described herein relate to home automation and home security, and related security systems and automation for use in commercial and business settings. As used herein, the phrase "home automation system" may refer to a system that includes automation features alone, security features alone, a combination of automation and security features, or a combination of automation, security and other features. While the phrase "home automation system" is used throughout to describe a system or components of a system or environment in which aspects of the present disclosure are described, such an automation system and its related features (whether automation and/or security features) may be generally applicable to other properties such as businesses and commercial properties as well as systems that are used in indoor and outdoor settings.

One aspect of the present disclosure relates to tracking the location of one or more individuals on a property being monitored by a home automation system. While the present disclosure is focused primarily on tracking the location of people, the systems and methods disclosed herein may be equally applicable to tracking the location of other objects such as, for example, pets, mobile electronic devices, eye glasses, and toys.

Many properties have certain rooms or areas that pose higher risks of danger than others. For example, a home may have an outdoor pool, a cupboard with cleaning supplies, a utility room with HVAC, hot water heater, and other appliances, a bathtub, and kitchen appliances such ovens or stoves that may pose higher safety risks than other areas of the home. These areas may pose relatively low risk for adults and other responsible persons. However, there may be others occupying the property that may be at higher risk if present in these areas without supervision. In particular, small children and elderly people may be at higher risk if able to access these areas of the home without proper supervision. Furthermore, there may be areas of a property that are private and/or require additional permission in order to access (e.g., an office space, computer room, bedroom, etc.).

Some aspects of the present disclosure provide notifications (e.g., alarms) when certain people are in relative high-risk areas or restricted access areas of a property (e.g., referred to herein as "high-risk areas" or "monitored areas"). The notification may be in the form of, for example, an audible message projected over a speaker system of the home automation system, a text message sent to a mobile computing device of a supervisor or other responsible persons located on the property or located remote from the property, or audible or text messages provided to the person who has accessed the high-risk area.

The use of long-wave technology (e.g., GPS and/or cellular technology) for the purpose of geo tracking an object is relatively well known. The present disclosure implements other technologies to track the location of one or more persons on a property. Such technologies are typically short-wave, wireless technologies such as radio frequency (RF), near field communication (NFC), WAVE, Bluetooth, ANT, Zigbee, Wi-Fi, IrDA, and the like technologies. Such short-wave technologies may utilize one or more sensors located in or at an entrance to the high-risk areas of the property. The short-wave sensors identify the presence of a short-wave transmitter that may be carried by the person of interest and/or other persons residing on the property. When the person of interest enters the high-risk area, the short-wave sensor identifies the presence of the person. In some embodiments, the sensor is carried by the person of interest and the short-wave transmitter is located in the high-risk area of the property.

Typically, the sensor transmits sensor data indicating that the person of interest, or at least a tracking device carried by the person of interest, is in the high-risk area. The sensor data may be used to generate the notification. In at least some examples, the sensor data is transmitted to a control panel, which may then generate the notification regarding the person of interest's proximity to the high-risk area of the property. In other examples, the sensor data is transmitted to a remote computing device such as a mobile computing device carried by one or more users, a central station, or other computing device that then generates the notification.

The transmitter (and/or sensor) carried by the person of interest may be in the form of, for example, a bracelet or anklet device. The device carried by the person of interest may be generally referred to as a tracking device. The person of interest (e.g., a child or elderly person) as well as other persons residing on the property may carry individual tracking devices. The home automation system may include a database that stores information associated with each tracking device. For example, each tracking device may have an identification code that is stored in the database. A person (or other object such as a pet) is associated with the identification code. For example, information related to a given person, such as age, gender, and/or relationship (e.g., family member or visitor), may be stored in association with the identification code.

The home automation system may include a plurality of rules that are operative based on functionality of the tracking devices and the specific high-risk areas of the property that require specific authorization to enter. For example, one rule may be established to generate a notification if a tracking device associated with a child under age 12 is located in any one of five different zones or areas of the property that have a risk level of three or greater (on a scale of 1-5). The notification may be transmitted if other rules are satisfied such as, for example, no other tracking devices are identified in the high-risk area. In some examples, the notification may be terminated and/or put on hold if a tracking device for an adult or other responsible person is located in the same high-risk area or in close proximity to the high risk area.

Another example rule relates to automated functions that may occur in addition to generation and transmission of a notification as a result of identifying a person of interest in a high-risk area of a property. For example, if the home automation system identifies a person of interest entering the pool area of a property, the home automation system may automatically operate the pool cover to close in order to lower the risk that the a person of interest will unintentionally fall into the pool. In another example, if a person of interest enters a high-risk room of a home, the home automation system may operate the door of that room into an open position to ensure that the person of interest can exit freely and/or be heard or seen by others in the home. In other embodiments, functions of the home automation system may be carried out in response to instructions provided by one or more users of the home automation system in response to receiving a notification that a person of interest is located in a certain area of the property.

Another aspect of the present disclosure relates to confirming the identity of a person wearing a tracking device using a secondary source. The primary source for identifying the person wearing the tracking device may be identified via the information stored in a database that correlates identification codes for the tracking device with a person who is intended to be wearing the tracking device. The secondary identification source may include, for example, face recognition, fingerprint recognition, identification via other physical features of the person, or verification of identity via an electronic device carried by the person (e.g., a cell phone or other mobile computing device). Using a secondary identification system may reduce the possibility of the person of interest intentionally replacing their own tracking device with the tracking device of another person, which may provide access to certain areas of the property which he/she may not otherwise be permitted to enter.

FIG. 1 is a block diagram illustrating one embodiment of an environment 100 in which the present systems and methods may be implemented. In some embodiments, the systems and methods described herein may be performed at least in part on or using a device 105. Environment 100 may also include a location sensor 115 and a tracking device 120, which may communicate with device 105 via a network 110. Examples of network 110 include cloud networks, local area networks (LAN), wide area networks (WAN), virtual private networks (VPN), wireless networks (using 802.11, for example), and/or cellular networks (using 3G and/or LTE, for example), etc. In some embodiments, network 110 may include the internet. Device 105 may include a location module 125. In some embodiments, one or the other of the location sensor 115 and tracking device 120 may communicate with device 105 via network 110. Location sensor 115 and tracking device 120 may communicate directly with each other.

Device 105 may include or be part of a control panel of the home automation system that is part of environment 100. Device 105 may include a plurality of features, components, and functionality including, for example, a controller or processor, a user interface, data storage capability (e.g., a database), speakers, microphones, a display screen, etc., for at least the purpose of facilitating operation of device 105 by one or more users. Device 105 may operate location module 125. Location module 125 may receive information from at least one of location sensor 115 and tracking device 120 to help determine, for example, a location of one or more persons and/or objects on a property being monitored by the home automation system and/or environment 100. Tracking device 120 may be carried by the person or object of interest. Location sensor 115 may determine when tracking device 120 has entered an area being monitored by location sensor 115. At least one of location sensor 115 and tracking device 120 may send data back to location module 125 via network 110 indicating that the tracking device 120 is in the area being monitored by location sensor 115. The location being monitored by location sensor 115 may be a high-risk area of the property and/or a particular area of the property that is intended to have limited access (i.e., access only by authorized users).

In some embodiments, each person who is granted access to the property may be required to carry a tracking device 120. Alternatively, only certain persons of interest may carry a tracking device 120. Typically, tracking device 120 includes a short-wave transmitter and location sensor 115 includes a short-wave receiver. In other embodiments, tracking device 120 may include the short-wave receiver and location sensor 115 may include a short-wave transmitter. Selecting which of the location sensor 115 and tracking device 120 includes the short-wave transmitter or receiver may depend on, for example, power requirements, size, weight, mobility considerations, and the like. In at least some embodiments, tracking device 120 may include a relatively simple, low-cost, lightweight short-wave wireless transmitter such as an RF transmitter or nearfield communication (NFC) transmitter in the form of, for example, a bracelet or anklet. As mentioned above, other communication mediums may be used including, for example, WAVE, Bluetooth, ANT, Zigbee, Wi-Fi, and IrDA. Tracking device 120 may include, for example, a rechargeable battery or a long-life power source.

Location sensor 115 may be positioned in an area of a property such as, for example, a high-risk or controlled access area. In one example, location sensor 115 is positioned in a doorway or other access point to the area being monitored. When tracking device 120 passes through the barrier, location sensor 115 may identify tracking device 120 and send sensor data back to location module 125 via network 110 concerning the location of tracking device 120 in the monitored area. Location module 125 may operate to generate a notice regarding the location of tracking device 120 on the property being monitored by the home automation system. The notification may be transmitted to any of a variety of persons using any desired communication medium. For example, location module 125 may transmit the notification in the form of a voice message, text message, email, or the like to another user associated with the monitored property. The user may be, for example, a parent or other responsible adult. The user may be located on the property or may be located remote from the property. In another example, the notification may be in the form of, for example, an audible, text, or visual message may be sent to the person carrying tracking device 120 to request that the person carrying tracking device 120 exit the area or be aware of danger associated with the monitored area.

Figure 2:
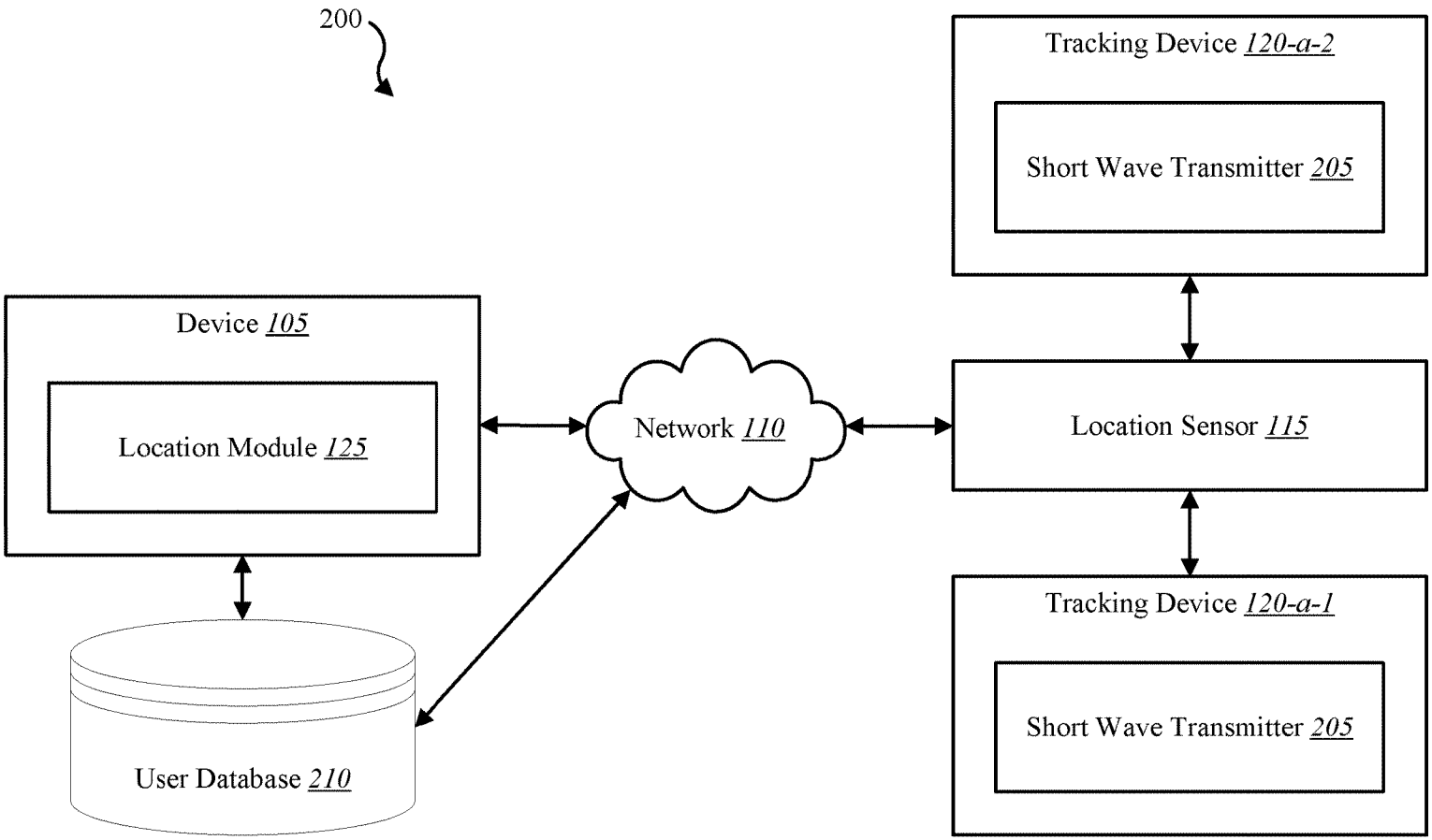
FIG. 2 is a block diagram of another environment in which the present systems and methods may be implemented.

FIG. 2 is a block diagram illustrating one embodiment of an environment 200 in which the present systems and methods may be implemented. Environment 200 may include the same or similar components as discussed above related to environment 100. In some embodiments, the systems and methods described herein may be performed at least in part on or using a plurality of tracking devices 120-*a* which each have a short-wave transmitter 205. Environment 200 may also include a user database 210.

Location sensor 115 may identify the presence of tracking devices 120-*a* by receiving signals from short-wave transmitters 205. As mentioned above, location sensor 115 may include a short-wave receiver used to receive short-wave signals from short-wave transmitters 205. Location sensor 115 may also include a transmitter that transmits sensor data via, for example, network 110 to location module 125. Short-wave transmissions from short-wave transmitters 205 may include, for example, an identification code associated with a particular tracking device 120-*a*. In one example, location sensor 115 is positioned at a one-way entry point into a monitored area of a property. Location sensor 115 may identify when tracking device 120-*a* passes through the one-way entry. Location sensor 115 may also sense when tracking device 120-*a* passes through the one-way entry in the opposite direction, indicating exit of the person of interest from the monitored area. In other examples, location sensor 115 may continuously sense that the tracking device 120-*a* is within the monitored area until such time as the tracking device 120-*a* moves outside of a sensing range of the location sensor 115 (e.g., a range of 10 to 20 ft.). The monitored area may have multiple exit and entry points and location sensor 115 may operate to determine whether the tracking device is within a predefined zone or area defined at least in part by the sensing range for the particular location sensor 115.

In one example, the tracking devices 120-*a* may be carried by separate persons of interest that are each unauthorized to access the monitored area being monitored by location sensor 115. Location sensor 115 may provide sensor data when either or both of tracking devices 120-*a* enters and/or exits the monitored area. Location module 125 may receive the data from location sensor 115, which data may include at least an identification code associated with the tracking device 120-*a*. The identification codes may be stored, for example, in user database 210. User database 210 may include other information about the user associated with a particular tracking device identification code.

The identification code and user information may also be associated with certain rules or conditions. The rules or conditions may include, for example, the areas of the property that the particular user can or cannot enter alone or enter without a certain person, such as an authorized person (e.g., which may be identified by a tracking device carried by that authorized person). Location module 125 may use the information stored in user database 210 to determine whether a notification should be generated and/or transmitted related to the determined location of the tracking devices 120-*a* and the person associated with the tracking devices 120-*a*.

In one example, tracking device 120-*a*-1 is associated with an unauthorized person of interest, and tracking device 120-*a*-2 is associated with an authorized person of interest. Location sensor 115 may identify both tracking devices 120-*a* as being within a monitored area. Location module 125 may receive data from location sensor 115 and may reference user database 210 for information related to the tracking devices 120-*a* and the persons assumed to be carrying those devices. Location module 125 may determine that, while the person carrying tracking device 120-*a*-1 is not authorized to enter the monitored area, the presence of an authorized person carrying tracking device 120-*a*-2 in that same area (or in close proximity to the monitored area) may eliminate the need to generate and/or send the notification.

User database 210 is shown as a separate component from device 105. In other embodiments, device 105 may include user database 210 as a component thereof. User database 210 may be included within the same housing as location module 125. Alternatively, user database 210 may be provided as a separate device and may be located remotely from device 105. In one example, user database 210 may be located at a separate computing device such as, for example, a desktop computer located at the property being monitored by the home automation system.

Environment 200 shows two separate tracking devices 120-*a*. In other examples, environment 200 may include more than two tracking devices, such as a separate tracking device 120-*a* associated with each person located at the property being monitored by the home automation system. Further, a single location sensor 115 is shown in environment 200. Alternatively, environment 200 may include a plurality of location sensors. A single monitored area may include a plurality of location sensors 115. One or more location sensors 115 may be arranged and configured to monitor each of a plurality of monitored areas of a property. The monitored areas may be both inside and outside of a building of the property. The monitored areas may pose potentially high-risk conditions such as, for example, a swimming pool, hot tub, electrical equipment, appliances, cleaning supplies, etc. Alternatively, the monitored area may simply be an area (e.g., a computer room or office, home theater, parents' bedroom, or the like) with access that is limited to certain users.

Location module 125 may operate based on rules associated not only with location of a tracking device within a monitored area, but the amount of time in which the tracking device is located within the monitored area. For example, location module 125 may determine, via data received from location sensor 115, that the tracking device 120-*a* has entered a monitored area. A notification or alarm is generated by location module 125 only if the tracking device 120-*a* is determined to be in the monitored area for more than a predetermined time (e.g., 30 seconds). This feature may help limit false alarm conditions in which the unauthorized person of interest enters for a valid reason (e.g., enters the pool area to retrieve a pool towel without the intent to go swimming) as opposed to entering the monitored area for other reasons which may be authorized based at least in part on the amount of time the user is in the monitored area.

Figure 3:
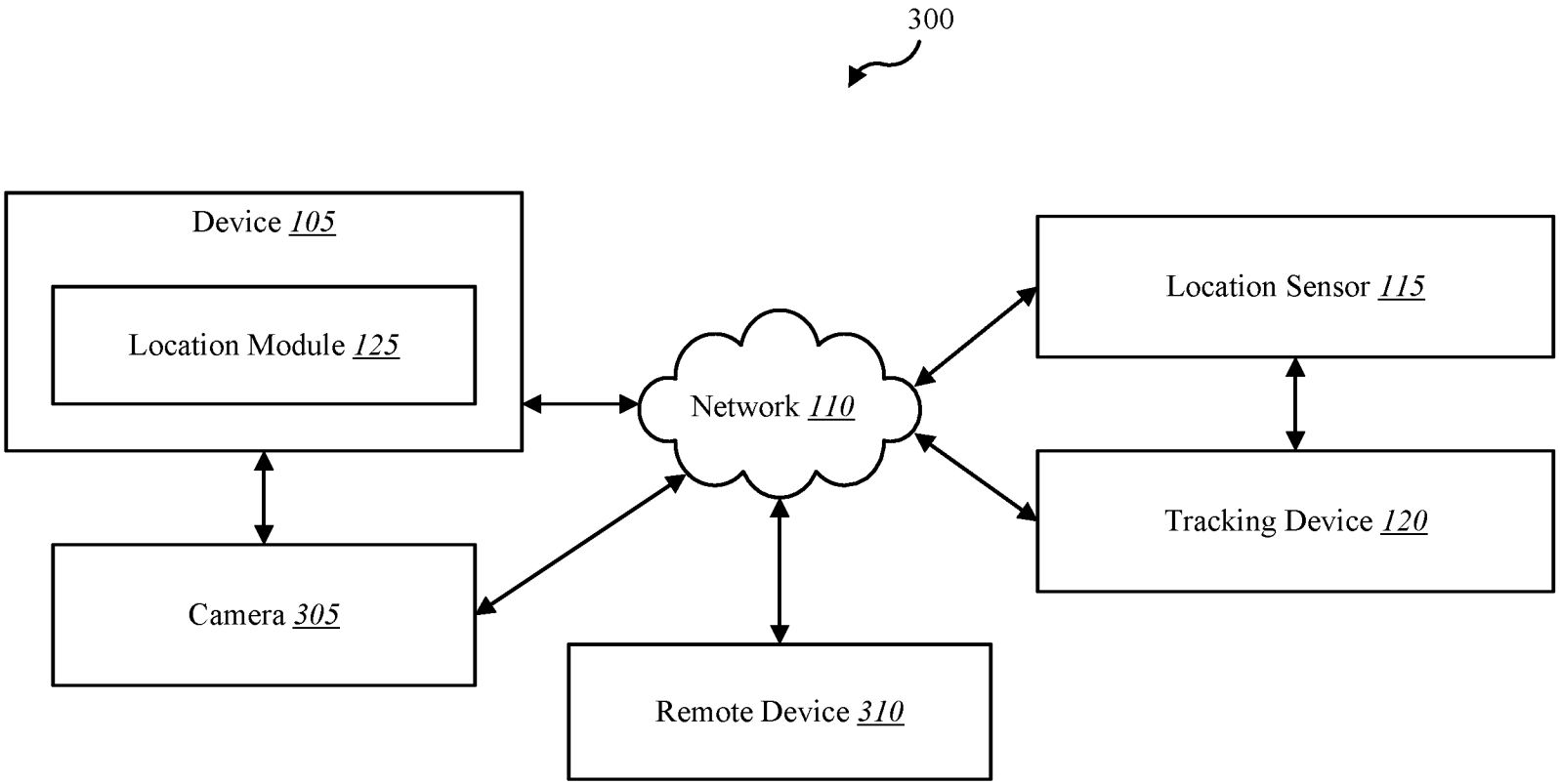
FIG. 3 is a block diagram of another environment in which the present systems and methods may be implemented.

FIG. 3 is a block diagram illustrating one embodiment of an environment 300 in which the present systems and methods may be implemented. Environment 300 may include at least some of the components of environments 100, 200 described above. Environment 300 may include, in addition to device 105, location sensor 115, and tracking device 120, a camera 305 and remote device 310.

Camera 305 may provide a secondary way to determine and/or confirm the location of tracking device 120. For example, location sensor 115 may identify that tracking device 120 is within a monitored area based on, for example, a short-wave signal received from tracking device 120. Camera 305 may be a video camera with a viewing area that covers at least a portion of the monitored area (e.g., an entry point to the monitored area). Location module 125 may reference information provided by camera 305 (e.g., video content) that confirms the tracking device 120 is in fact within the monitored area. Camera 305 may additionally help confirm the identity of the person carrying tracking device 120. As discussed above, each tracking device 120 may be associated with a particular person. Camera 305 may confirm that the person in the monitored area is the same person as the person that is associated with tracking device 120. Camera 305 may assist in providing, for example, face recognition of the person carrying tracking device 120. Additionally, or alternatively, camera 305 may provide motion detection.

In some examples, location module 125 may monitor information from camera 305 and determine that a person is within a monitored area of the property. Location module 125 may then reference information from location sensor 115 to determine whether the person in the monitored area is a person associated with (e.g., carrying) tracking device 120. In this way, location module 125 may help determine whether a given person in a monitored area can be ruled out as an unauthorized person (e.g., a burglar) if that person is carrying tracking device 120 and is per se authorized to be on the property and/or the specific monitored area. Tracking device 120 may in this way indicate whether those persons in monitored areas of a property are authorized to be in any area of the property.

Camera 305 may provide video content as well as still shot photographs. The content provided by camera 305 may be stored, for example, on a storage device of device 105. Additionally, or alternatively, the content from camera 305 may be stored remotely such as in a remote database or server. The content collected by camera 305 may be referenced at a separate time from operation of location module 125 to determine that tracking device 120 is within a monitored area. For example, a parent of a home may, after receiving a notification from location module 125 that tracking device 120 is within a monitored area, manually access the stored content from camera 305 to determine what activities the person carrying tracking device 120 was engaged in the monitored area. In other embodiments, video clips corresponding to a time with the monitored area is accessed by a person carrying the tracking device, is sent along with the notification to a supervisor or other user.

Remote device 310 may receive notifications sent from location module 125. Remote device 310 may be remote from device 105 while still remaining on the property being monitored by the home automation system. Additionally, or alternatively, remote device 310 may be located physically at a location that is remote from the property being monitored by the home automation system. Remote device 310 may include, for example, a desktop computer, a laptop computer, or a mobile computing device such as a smartphone or tablet computing device.

The notifications sent from location module 125 may be in the form of, for example, an audio message, a text message, a light signal, or the like. Remote device 310 may operate an app that is customizable to create user desired notifications based on receiving information (e.g., a notification) from location module 125. Remote device 310 may be operable to transmit instructions from a user to device 105 in response to the notification received from location module 125. For example, remote device 310 may be used to generate and transmit instructions related to, for example, opening or closing a barrier associated with the monitored area, generating notifications to be sent to the person of interest carrying tracking device 120 (e.g., send a text message or call a cell phone), or initiate some other action taken by a component of or device in communication with the home automation system. In one example, remote device 310 instructs camera 305 to begin recording in response to receiving a notification from location module 125 if tracking device 120 is within the monitored area. Alternatively, remote device 310 may access the content generated by camera 305 that covers a time period (e.g., 10 seconds before and 10 seconds after) during which the tracking device 120 was identified to be within the monitored area.

Figure 4:
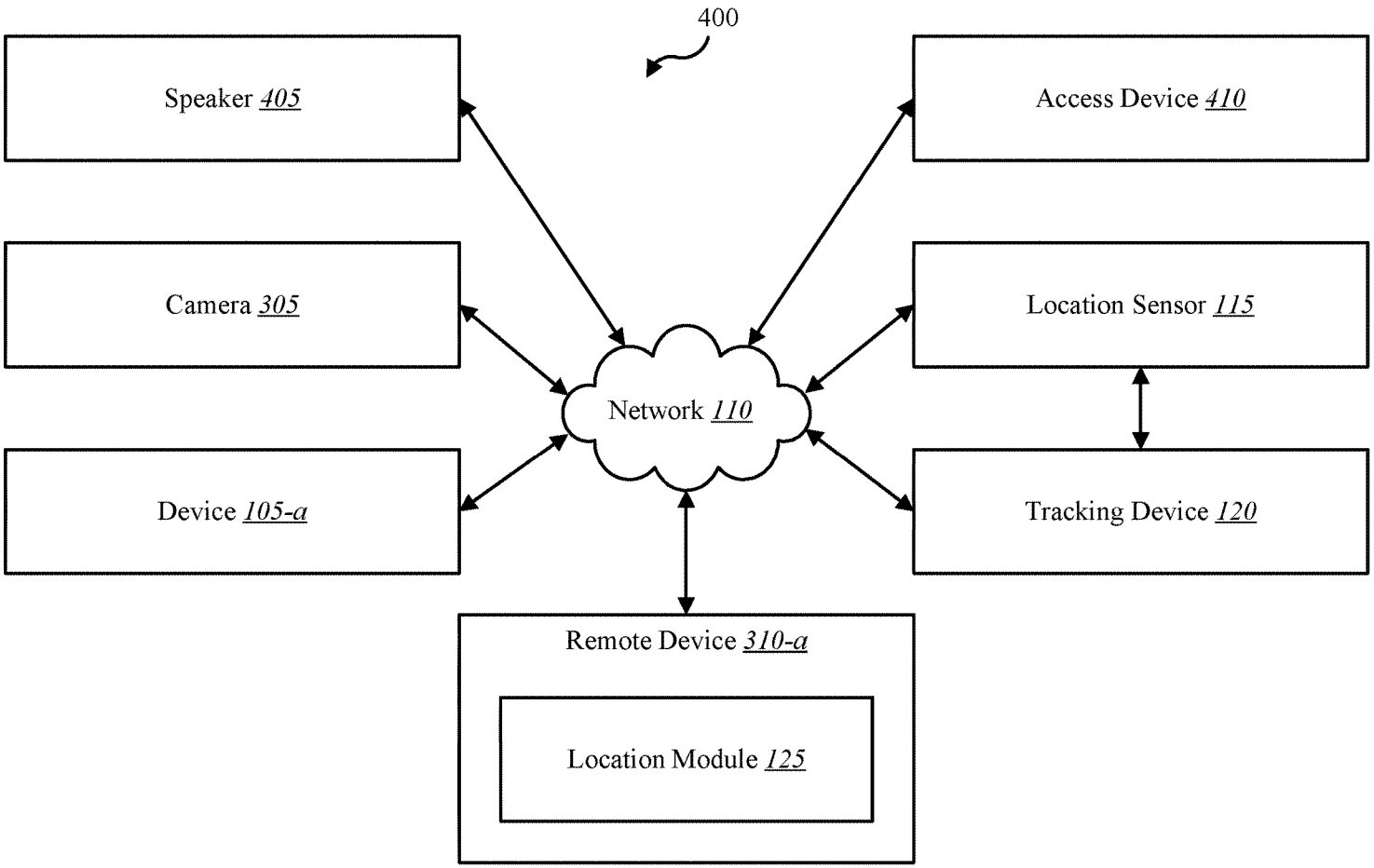
FIG. 4 is a block diagram of another environment in which the present systems and methods may be implemented.

FIG. 4 is a block diagram illustrating one embodiment of an environment 400 in which the present systems and methods may be implemented. Environment 400 may include at least some of the same components of the environments 100, 200, 300 described above. Environment 400 may include a device 105-*a*, a location sensor 115, a tracking device 120, a camera 305, a remote device 310-*a*, a speaker 405, and an access control device 410. The components of environment 400 may communicate via, for example, network 110. Network 110 may provide wired and/or wireless communication between the components of environment 400.

Remote device 310-*a* may include location module 125 instead of the location module 125 being operated by device 105-*a*. Remote device 310-*a* may be separate from device 105-*a*. Remote device 310-*a* may be located remote from the property being monitored by the home automation system of environment 400.

Data from at least one of location sensor 115 and tracking device 120 concerning the location of tracking device 120 relative to a monitored area may be transmitted to remote device 310-*a*. Location module 125 may operate to generate a notice in response to the information corresponding to the location of tracking device 120. Location module 125 may operate to provide any of the functionality described above with reference to environments 100, 200, 300.

In one example, location module 125 generates a notice that is transmitted to device 105-*a*. Device 105-*a* may operate one or more speakers 405 located at the property being monitored by the home automation system. The notice may be in the form of an audible notice conveyed by speaker 405. Speaker 405 may be positioned in close proximity to, for example, the monitored area to provide an audible notice to the person carrying tracking device 120 and/or another person in the vicinity who could check on the person carrying tracking device 120. In some examples, the notification from location module 125 may be sent directly to speaker 405 rather than being routed through device 105-*a*. In another example, speaker 405 is integrated into device 105-*a* (e.g., mounted in a common housing of device 105-*a*). Speaker 405 may be part of, for example, a mobile computing device secured by the person who is carrying tracking device 120. Speaker 405 may be part of a mobile computing device carried by one or more users of the home automation system, such as a person who is authorized to be located in the monitored area.

Location module 125 may operate camera 305 directly or via device 105-*a*. Location module 125 may communicate via two-way communication with location sensor 115 and/or tracking device 120. As discussed above, location module 125 may reference information stored in a database such as user database 210 as part of determining whether a notification should be generated and/or transmitted in response to receiving information about the location of tracking device 120.

Access control device 410 may include, for example, one or more features or functions that assist in controlling access to the monitored area or a portion thereof. Access control device 410 may include, for example, a barrier closure device that is operable to open and/or close a barrier providing access to the monitored area. For example, access control device 410 may include controls for closing a pool cover, opening or closing a gate or door, turning off a water supply, operating an HVAC system, turning on or off an appliance, etc. Location module 125 may operate at least in part to control access control device 410 in response to information received concerning location of tracking device 120. One or more access control devices 410 may be associated with each monitored area.

Location module 125 may be a component of remote device 310-*a*. Additionally, or alternatively, location module 125 may be a separate component from remote device 310-*a*, and may be operated at least in part via remote device 310-*a*. In at least some examples, either or both of device 105-*a* and remote device 310-*a* may operate location module 125.

Figure 5:
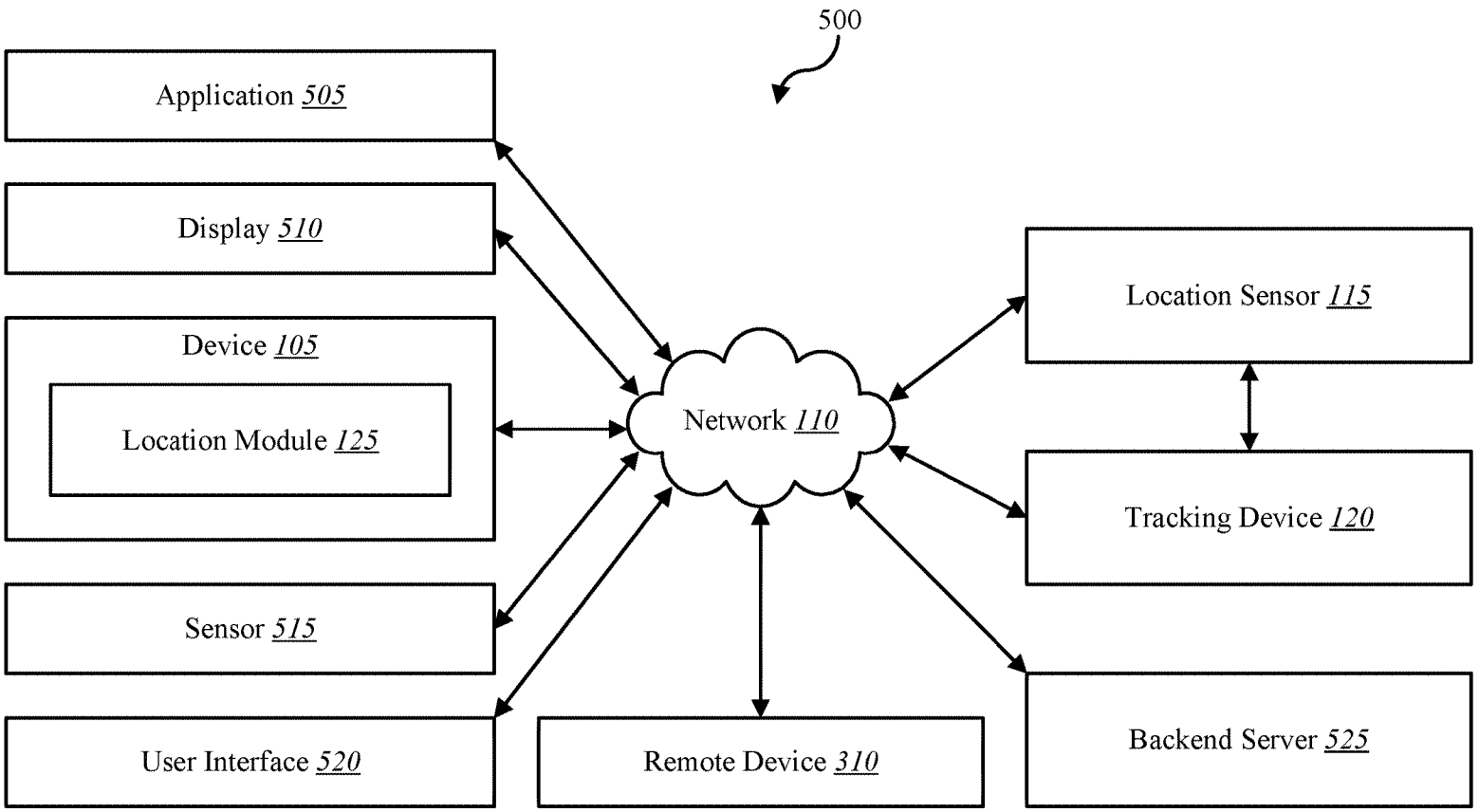
FIG. 5 is a block diagram of another environment in which the present systems and methods may be implemented.

FIG. 5 is a block diagram illustrating one embodiment of an environment 500 in which the present systems and methods may be implemented. Environment 500 may include at least some of the same components as environments 100, 200, 300, 400. Environment 500 may include, in addition to device 105, location sensor 115, tracking device 120, and remote device 310, an application 505, display 510, sensor 515, user interface 520, and central station 525. Any of the components of environment 500 may be included in the environments 100, 200, 300, 400 described herein.

Application 505 may allow a user (e.g., a user interfacing directly with device 105 located at a property being monitored by the home automation system) to control, either directly or via device 105 and/or remote device 310, an aspect of the monitored property including security, energy management, locking and unlocking doors, checking the status of the door, locating a user or item, controlling lighting, thermostat, or cameras, and receiving notifications regarding a current status or anomaly associated with a home, office, place of business, and the like (e.g., a property). In some configurations, application 505 may enable device 105 to communicate with central station 525, location sensor 115, and/or tracking device 120, and provide the user interface 520 to display an automation, security, and/or energy management content on device 105 and/or remote device 310. Thus, application 505, via user interface 520, may allow users to control aspects of their home, office, and/or other type of property. Further, application 505 may be installed on device 105, remote device 310, or other component and/or feature of the home automation system. Application 505 may facilitate generation of an alarm/notification in response to location information provided via tracking device 120. Application 505 may operate to determine when the tracking device is no longer in a monitored area.

Display 510 may include, for example, a digital display as part of, for example, a control panel of environment 500 (e.g., a control panel of the home automation system). Display 510 may be part of device 105. Display 510 may be provided via devices such as, for example, a desktop computer or a mobile computing device (e.g., remote device 310) such as a handheld mobile device. In at least some examples, display 510 may be either permanently mounted (e.g., mounted to a wall of a home), or may be a mobile device or accessible via a mobile device. The user interface 520 may be integrated into display 510. Such a user interface 520 may include a plurality of menus, screens, microphones, speakers, cameras, and other capability that permit interaction between the user and the home automation system, or any components of environment 500. Additionally, or alternatively, the user interface 520, with display 510, may be integrated into device 105, remote device 310, or other features of a home automation system.

Sensor 515 may include, for example, a camera sensor, an audio sensor, a forced entry sensor, a shock sensor, a proximity sensor, a boundary sensor, an appliance sensor, a light fixture sensor, a temperature sensor, a light beam sensor, a three-dimensional (3D) sensor, a motion sensor, a smoke sensor, a glass break sensor, a door sensor, a video sensor, a carbon monoxide sensor, an accelerometer, a global positioning system (GPS) sensor, a Wi-Fi positioning sensor, a capacitance sensor, a radio frequency sensor, a near-field sensor, a heartbeat sensor, a breathing sensor, an oxygen sensor, a carbon dioxide sensor, a brainwave sensor, a motion sensor, a voice sensor, a touch sensor, and the like. Device 105 and tracking device 120 may have included or have integrated therein one or more of the sensors 515. Although sensor 515 is depicted as a separate component from device 105 and remote device 310, in some embodiments, sensor 515 may be connected directly to any one of those components or other components of environment 500. Additionally, or alternatively, sensor 515 may be integrated into a home appliance or fixture such as a lighting fixture.

Sensor 515 may be used in cooperation with location sensor 115 to help determine a location of tracking device 120. Sensor 515 may include, for example, a motion sensor, a heat sensor, a proximity sensor, etc. to provide a secondary source of data to confirm that tracking device 120 is within a monitored area.

Central station 525 may provide additional support for the home automation system including, for example, additional data storage capacity for device 105, capability to communication notifications, send emergency or maintenance personnel in response to information about the location of tracking device 120, and the like. Central station 525 may include a server such as a backend server, a database, or the like.

Figure 6:
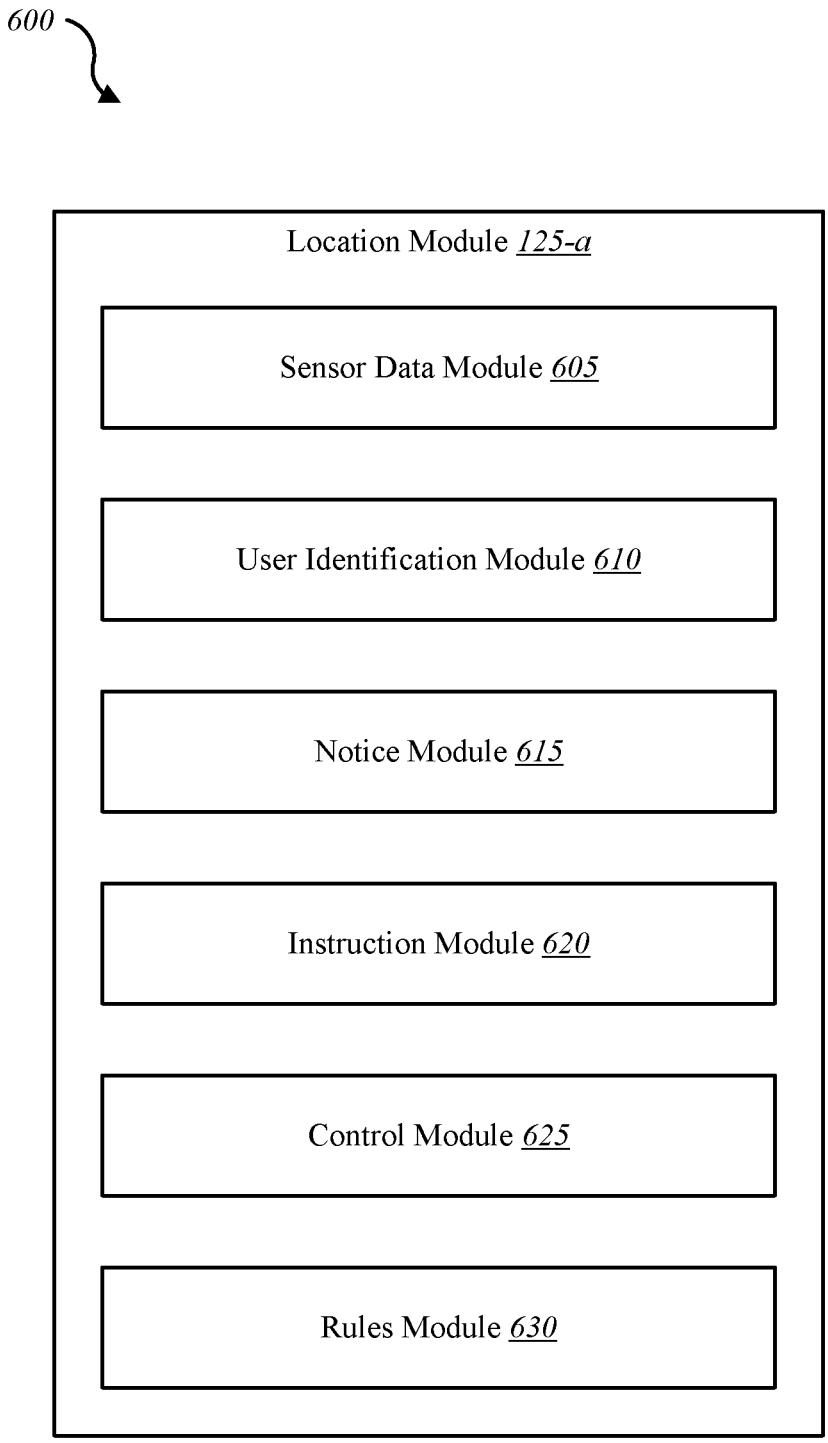
FIG. 6 is a block diagram of an example location module of the environments shown in FIGS. 1-5.

FIG. 6 is a block diagram illustrating an example location module 125-*a*. Location module 125-*a* may be one example of the location modules 125 described above with reference to FIGS. 1-5. Location module 125-*a* may include a sensor data module 605, a user identification module 610, a notice module 615, an instruction module 620, a control module 625, and a rules module 630. In other embodiments, location module 125-*a* may include more or fewer of the modules shown in FIG. 6. The modules of location module 125-*a* may be operated using other components of a home automation system such as any of the components shown with reference to environments 100, 200, 300, 400, 500 described above with reference to FIGS. 1-5.

Sensor data module 605 may operate to receive data from location sensor 115 (see FIGS. 1-5). Sensor data module 605 may provide two-way communication with location sensor 115. In at least some examples, sensor data module 605 may receive sensor data from tracking device 120 or sensor 515 (see FIG. 5). Sensor data module 605 may perform at least some logic or controls related to the sensor data it receives as part of determining that tracking device 120 is within a monitored area of the property.

User identification module 610 may operate to determine what person is associated with a given tracking device. As described above, a tracking device code may be conveyed as part of location sensor 115 identifying the presence of tracking device 120. The tracking device code may be delivered to location module 125-*a*. User identification module 610 may reference a database (e.g., user database 210) to determine what person is associated with a given tracking device. Once a user is identified, some of the rules by which location module 125-*a* operates may be used to determine whether a notification should be generated in response to the determined location of the tracking device. User identification module 610 may also reference other material, data or resources such as, for example, video content from a camera (e.g., camera 305), motion sensor data from, for example, sensor 515, or data from an electronic device carried by the user who is carrying tracking device 120 (e.g., signals from a cell phone).

Notice module 615 may operate to generate a notification in response to a determined location of tracking 120. Notice module 615 may generate notices in the form of, for example, audio message, text messages, video messages, visual indicators (e.g., light patterns), or other signals that may be utilized to inform other persons concerning the location of tracking device 120 or to inform the person carrying tracking device 120. Notice module 615 may operate at least in part based on information received from sensor data module 605 and/or user identification module 610.

Instruction module 620 may operate to receive instructions from a separate device such as, for example, remote device 310. The instructions from the remote device 310 may be sent in response to a notification received at remote device 310 concerning the location of tracking device 120.

Control module 625 may operate to provide instructions for operation of one or more components of the home automation system in response to the notice generated by notice module 615. For example, control module 625 may generate and transmit instructions for operation of a barrier control member such as, for example, access control device 410.

Rules module 630 may include a plurality of rules and or generate rules for operation of location module 125-*a* upon receiving data concerning a location of tracking device 120. Rules stored by rules module 630 may be preprogrammed based on a certain number or type of tracking devices 120. Alternatively, rules module 630 may generate and/or store rules that are customizable based on the particular users carrying tracking devices 120, the monitored areas of the property, the types of tracking devices 120 used with the home automation system, and the like. Rules module 630 may be updated via, for example, instruction module 620. Additionally, or alternatively, rules module 630 may operate to generate a plurality of rules via a user interface with device 105 or remote device 310. Rules module 630 may be used to generate the rules, to modify the rules, to store the rules, and/or to access the rules by which location module 125-*a* operates.

Figure 7:
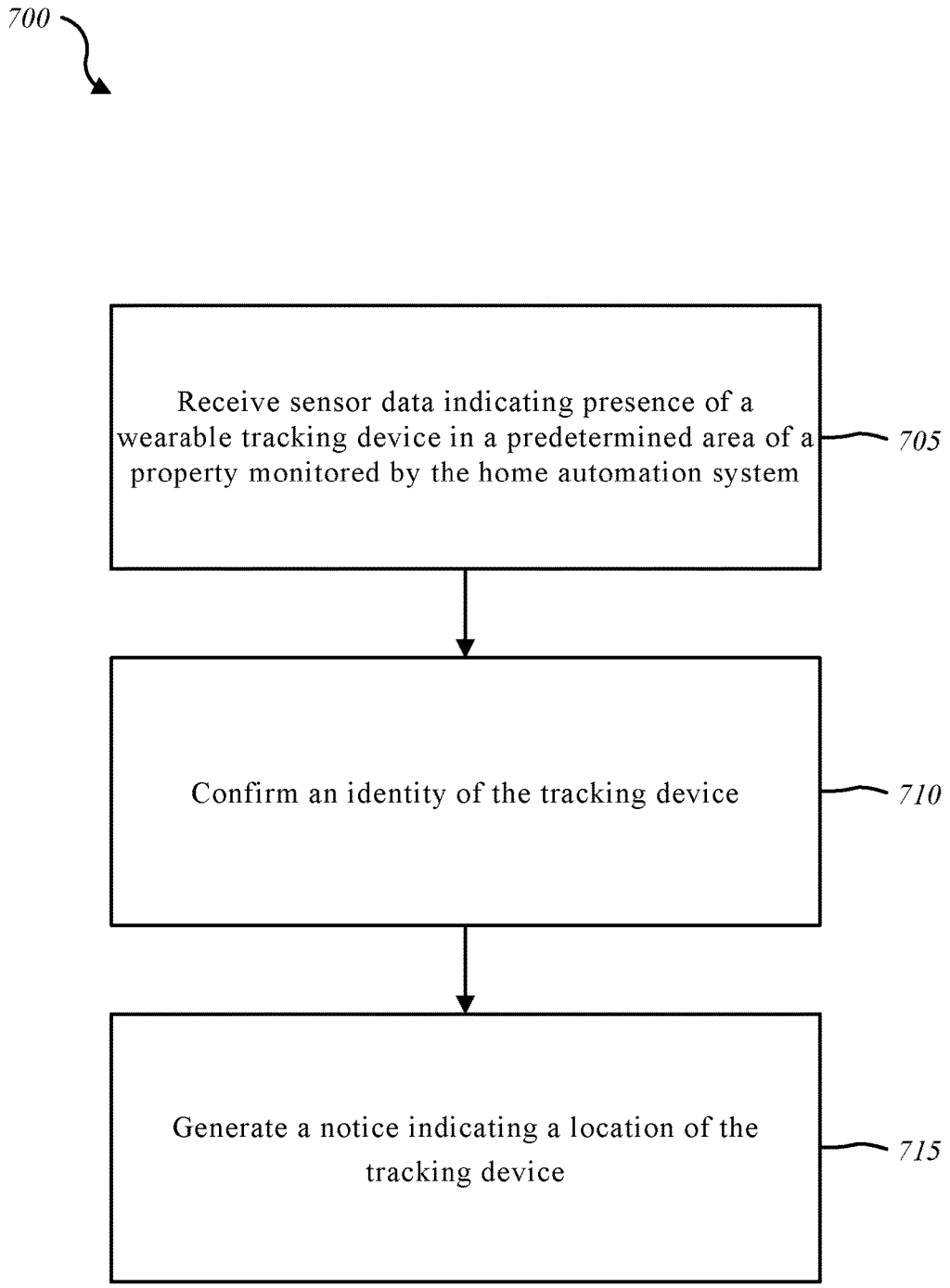
FIG. 7 is a flow diagram illustrating a method for tracking location using a home automation system.

FIG. 7 is a flow diagram illustrating one embodiment of a method 700 for tracking location using a home automation system. In some configurations, the method 700 may be implemented by the location modules 125 shown and described with reference to FIGS. 1-6. In other examples, the method 700 may be performed generally by device 105 or remote device 310 shown in FIGS. 1-5, or even more generally by environments 100, 200, 300, 400, 500 shown in FIGS. 1-5.

At block 705, the method 700 includes receiving sensor data indicating presence of a wearable tracking device in a predetermined area of a property monitored by a home automation system. Block 710 includes confirming an identity of the tracking device. Block 715 includes generating a notice indicating a location of the tracking device.

The method 700 may also include generating suggested actions to be taken in response to the identified location of the tracking device. Confirming the identity of the tracking device may include taking a picture or generating video content of at least one of the tracking devices, a person wearing the tracking device, and at least a portion of the predetermined area. Confirming the identity of the tracking device may include comparing an identification code for the tracking device to a database of identification codes associated with occupants of the property. The home automation system may include at least one proximity sensor positioned in the predetermined area, and receiving sensor data may include receiving sensor data from the at least one proximity sensor. The at least one proximity sensor may be a radio frequency sensor.

The method 700 may include transmitting the notice to a remote computing device. The method 700 may include receiving instructions from the remote computing device, and performing at least one action related to the tracking device in response to the instructions. The tracking device may be a wristband or an anklet wearable by one of a person and a pet. Method 700 may include receiving sensor data indicating presence of another wearable tracking device in the predetermined area, confirming an identity of another tracking device, and terminating the notice based on the confirmed identity of another tracking device. The property may include a plurality of predetermined areas, and the method 700 may include assigning a priority level to each of the plurality of predetermined areas, wherein the notice is dependent at least in part on the assigned priority level.

Figure 8:
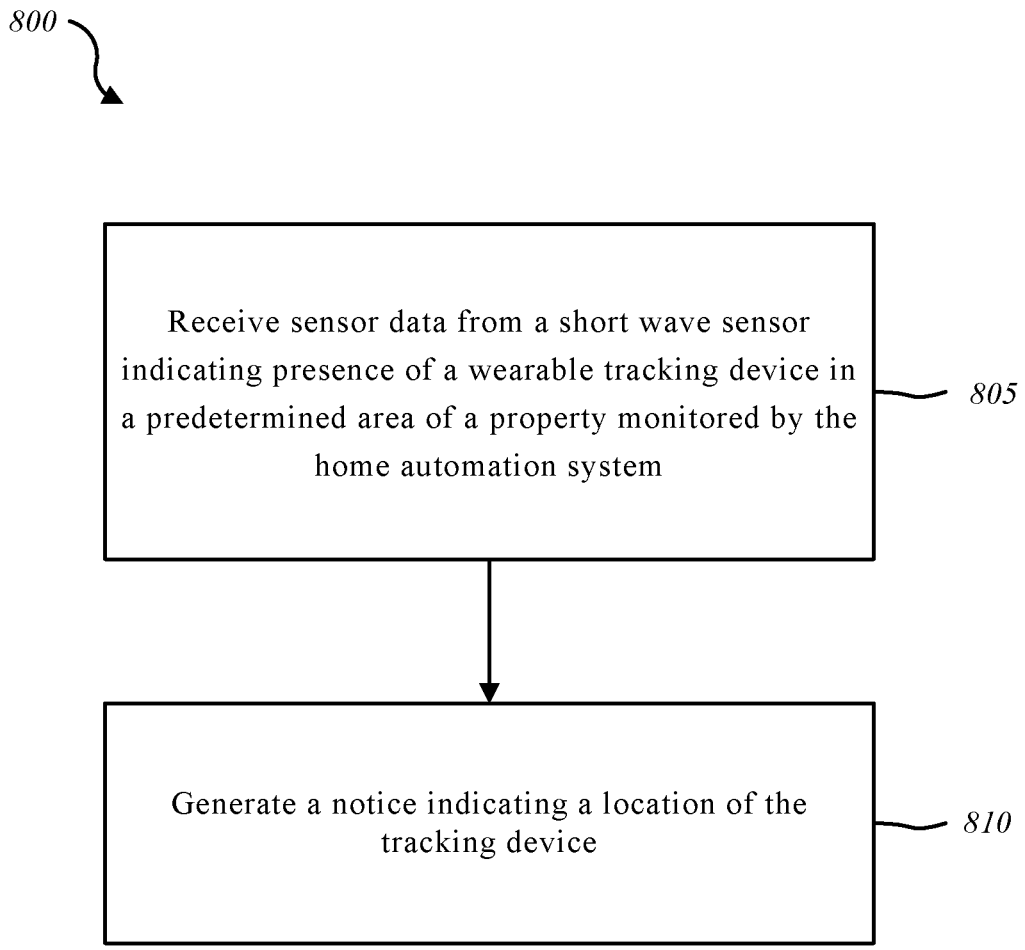
FIG. 8 is a flow diagram illustrating another method for tracking location using a home automation system.

FIG. 8 is a flow diagram illustrating one embodiment of a method 800 for determining location using a home automation system. In some configurations, the method 800 may be implemented by the location modules 125 described with reference to FIGS. 1-6. In other examples, the method 800 may be performed generally by device 105 or remote device 310 shown in FIGS. 1-5, or even more generally by the environments 100, 200, 300, 400, 500 shown in FIGS. 1-5.

At block 805, the method 800 includes receiving sensor data from a short-wave sensor indicating presence of a wearable tracking device in a predetermined area of a property monitored by the home automation system. Block 810 includes generating a notice indicating a location of the tracking device.

The method 800 may include confirming an identity of the person wearing the tracking device. Generating the notice may include generating an audible message. Generating the notice may include transmitting a message to a mobile computing device. The method 800 may include operating a feature of the home automation system to limit access to the predetermined area in response to the notice.

Figure 9:
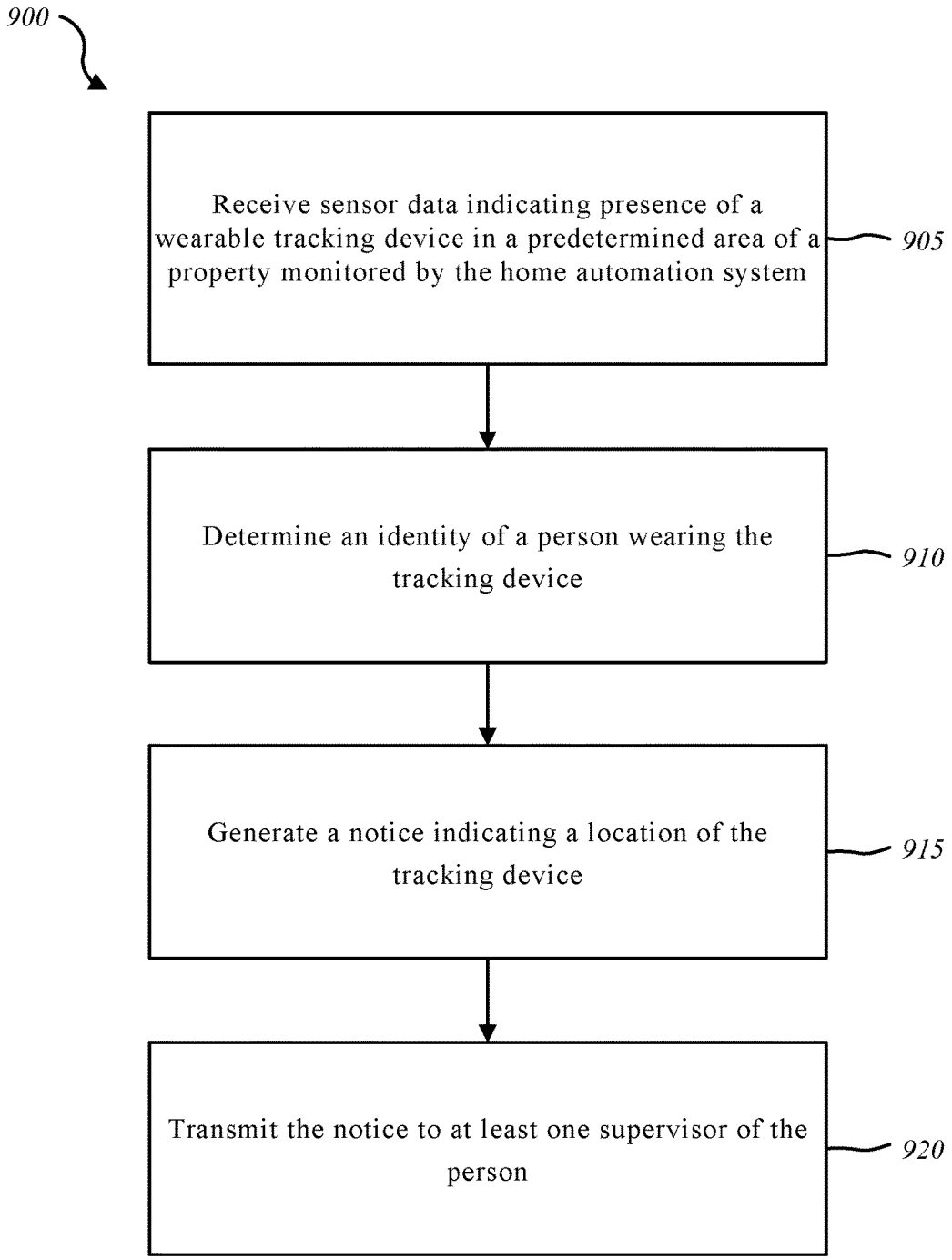
FIG. 9 is a flow diagram illustrating another method for tracking location using a home automation system.

FIG. 9 is a flow diagram illustrating one embodiment of a method 900 for tracking location using a home automation system. In some configurations, the method 900 may be implemented by the location modules described with reference to FIGS. 1-6. In other examples, method 900 may be performed generally by device 105 or remote device 310 shown in FIGS. 1-5, or even more generally by the environments 100, 200, 300, 400, 500 shown in FIGS. 1-5.

At block 905, the method 900 includes receiving sensor data indicating presence of a wearable tracking device in a predetermined area of a property monitored by the home automation system. Block 910 includes determining an identity of the person wearing the tracking device. Block 915 includes generating a notice indicating a location of the tracking device. Block 920 includes transmitting the notice to at least one supervisor of the person.

Determining the identity of the person may include monitoring video content from at least one camera having a viewing area of the predetermined area. The method 900 may include transmitting the notice to the person wearing the tracking device. Determining of the identity of the person may include searching a database for information about the person associated with the wearable tracking device.

Figure 10:
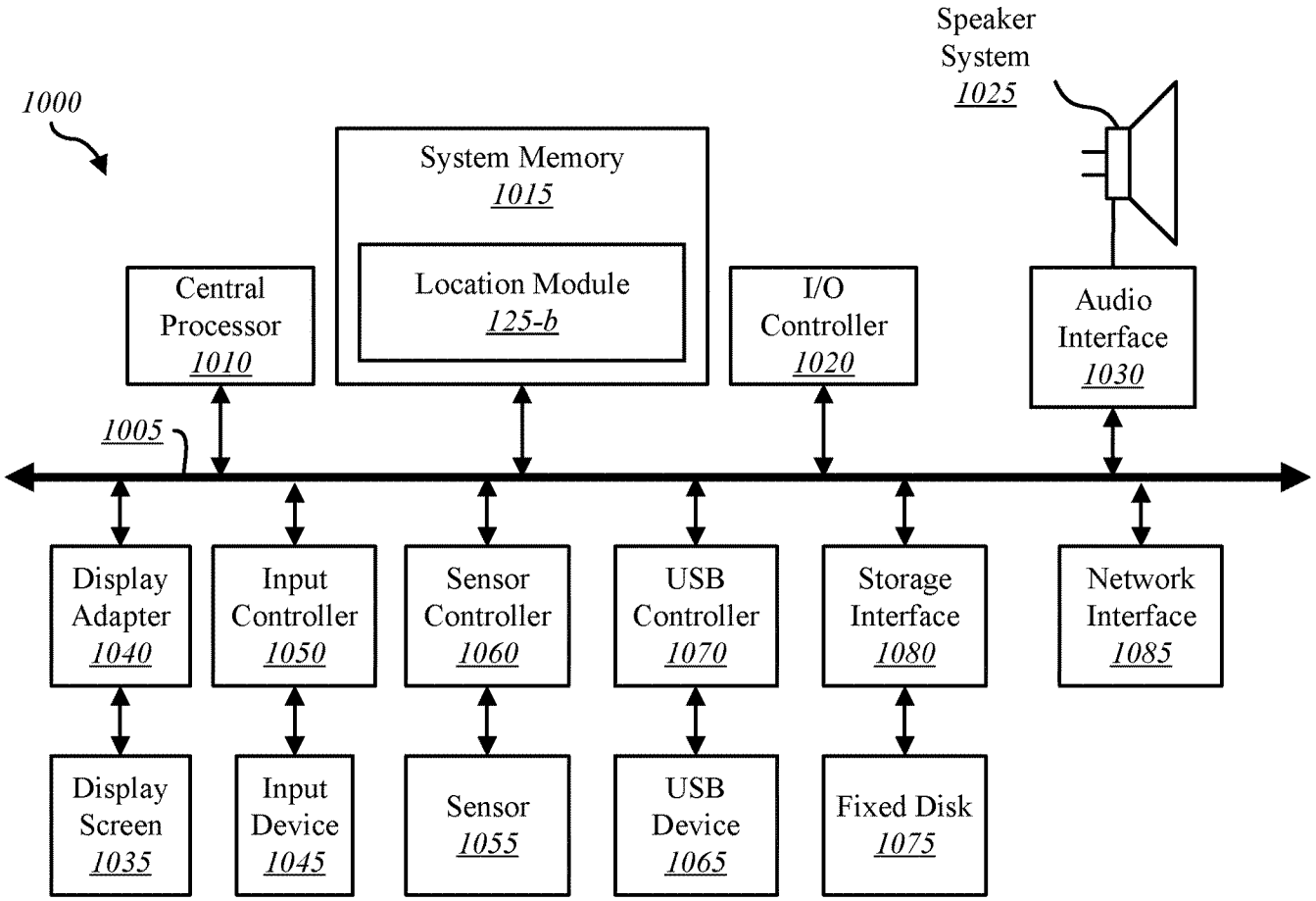
FIG. 10 is a block diagram of a computer system suitable for implementing the present systems and methods of FIGS. 1-9.

FIG. 10 depicts a block diagram of a controller 1000 suitable for implementing the present systems and methods. In one configuration, controller 1000 includes a bus 1005 which interconnects major subsystems of controller 1000, such as a central processor 1010, a system memory 1015 (typically RAM, but which may also include ROM, flash RAM, or the like), an input/output controller 1020, an external audio device, such as a speaker system 1025 via an audio output interface 1030, an external device, such as a display screen 1035 via display adapter 1040, an input device 1045 (e.g., remote control device interfaced with an input controller 1050), multiple USB devices 1065 (interfaced with a USB controller 1070), and a storage interface 1080. Also included are at least one sensor 1055 connected to bus 1005 through a sensor controller 1060 and a network interface 1085 (coupled directly to bus 1005).

Bus 1005 allows data communication between central processor 1010 and system memory 1015, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the location module 125-*b* to implement the present systems and methods may be stored within the system memory 1015. Applications resident with controller 1000 are generally stored on and accessed via a non-transitory computer readable medium, such as a hard disk drive (e.g., fixed disk 1075) or other storage medium. Additionally, applications can be in the form of electronic signals modulated in accordance with the application and data communication technology when accessed via network interface 1085.

Storage interface 1080, as with the other storage interfaces of controller 1000, can connect to a standard computer readable medium for storage and/or retrieval of information, such as a fixed disk drive 1075. Fixed disk drive 1075 may be a part of controller 1000 or may be separate and accessed through other interface systems. Network interface 1085 may provide a direct connection to a remote server via a direct network link to the Internet via a POP (point of presence). Network interface 1085 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 1000 wirelessly via network interface 1085.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 10 need not be present to practice the present systems and methods. The devices and subsystems can be interconnected in different ways from that shown in FIG. 10. The aspect of some operations of a system such as that shown in FIG. 10 are readily known in the art and are not discussed in detail in this application. Code to implement the present disclosure can be stored in a non-transitory computer-readable medium such as one or more of system memory 1015 or fixed disk 1075. The operating system provided on controller 1000 may be iOS®, ANDROID®, MS-DOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A method for a security and automation system, comprising:

detecting a wearable tracking device at a premises;

receiving, from a database, a first identity confirmation associated with the wearable tracking device based at least in part on the detecting;

receiving, from a camera, a second identity confirmation of an individual possessing the wearable tracking device at the premises;

validating an identity of the individual possessing the wearable tracking device and a location of the individual within a monitored area based at least in part on the first identity confirmation and the second identity confirmation;

determining a risk level associated with the monitored area based at least in part on the identity of the individual possessing the wearable tracking device and a determination that the location of the individual is within the monitored area;

determining a presence of an additional wearable tracking device within a range of the monitored area based at least in part on a third identity confirmation received from the database and a fourth identity confirmation received from the camera;

determining to transmit a notification to an individual associated with the security and automation system based at least in part on the presence of the additional wearable tracking device within the range of the monitored area and that the additional wearable tracking device is within the monitored area for a period satisfying a threshold; and initiating a function of the security and automation system based at least in part on the risk level associated with the monitored area, the presence of the additional wearable tracking device, and the individual being located within the monitored area for a duration greater than a pre-configured threshold.

2. The method of claim 1, wherein detecting the wearable tracking device at the premises is based at least in part on receiving sensor data indicating presence of the wearable tracking device.

3. The method of claim 2, wherein receiving the sensor data indicating the presence of the wearable tracking device is based at least in part on triggering of a sensor associated with the premises by the wearable tracking device.

4. The method of claim 1, wherein the database is located locally at the premises associated with the security and automation system.

5. The method of claim 1, further comprising:

correlating an identification code of the wearable tracking device with a value stored in the database, the value indicating a person authorized to possess the wearable tracking device, wherein receiving the first identity confirmation is based at least in part on the correlating.

6. The method of claim 1, further comprising:

receiving picture or video content from the camera, wherein the picture or video content comprises an image of at least one of the wearable tracking device, the individual possessing the wearable tracking device, or at least a portion of the premises, wherein receiving, from the camera, the second identity confirmation is based at least in part on the received picture or video content.

7. The method of claim 1, further comprising:

determining a number of sub-areas of the premises; and assigning the risk level to each of the sub-areas based at least in part on a characteristic associated with each sub-area.

8. The method of claim 7, further comprising:

modifying the risk level of each of the sub-areas based at least in part on a pre-configured rule that associates each of the sub-areas with one or more authorized wearable tracking devices.

9. The method of claim 1, further comprising:

generating a notification based at least in part on the validated identity of the individual, the notification indicating a location of the wearable tracking device; and transmitting the notification to a remote computing device.

10. The method of claim 9, further comprising:

automatically initiating the function of a component of the security and automation system based at least in part on the validated identity of the individual.

11. The method of claim 9, further comprising:

determining that the wearable tracking device enters a pre-configured boundary of a sub-area of the premises based at least in part on sensor data; and computing a displacement direction between the wearable tracking device and the pre-configured boundary; and identifying an action of the individual based at least in part on the computing, wherein generating the notification is further based at least in part on the identifying.

12. The method of claim 9, further comprising:

detecting that the wearable tracking device is within a sub-area of the premises; and determining that the wearable tracking device is located within the sub-area for the duration exceeding the pre-configured threshold.

13. The method of claim 12, further comprising:

initiating the function of the security and automation system based at least in part on the duration exceeding the pre-configured threshold.

14. The method of claim 13, further comprising:

detecting a second wearable tracking device at the premises based at least in part on receiving sensor data indicating a triggering of a sensor associated with the premises by the second wearable tracking device;

validating an identity of an individual carrying the second wearable tracking device based at least in part on receiving a third identity confirmation and a fourth identity confirmation; and generating a second notification based at least in part on the confirmation, the second notification indicating a location of the second wearable tracking device.

15. The method of claim 14, further comprising:

terminating the function based at least in part on the confirmation.

16. An apparatus for a security and automation system, comprising:

a processor;

a memory in electronic communication with the processor; and instructions stored in the memory, the instructions being executable by the processor to:

detect a wearable tracking device at a premises;

receive, from a database, a first identity confirmation associated with the wearable tracking device based at least in part on the detecting;

receive, from a camera, a second identity confirmation of an individual possessing the wearable tracking device at the premises;

validate an identity of the individual possessing the wearable tracking device and a location of the individual within a monitored area based at least in part on the first identity confirmation and the second identity confirmation;

determine a risk level associated with the monitored area based at least in part on the identity of the individual possessing the wearable tracking device and a determination that the location of the individual is within the monitored area;

determine a presence of an additional wearable tracking device within a range of the monitored area based at least in part on a third identity confirmation received from the database and a fourth identity confirmation received from the camera;

determine to transmit a notification to an individual associated with the security and automation system based at least in part on the presence of the additional wearable tracking device within the range of the monitored area and that the additional wearable tracking device is within the monitored area for a period satisfying a threshold; and initiate a function of the security and automation system based at least in part on the risk level associated with the monitored area, the presence of the additional wearable tracking device, and the individual being located within the monitored area for a duration greater than a pre-configured threshold.

17. The apparatus of claim 16, wherein detecting the wearable tracking device at the premises is based at least in part on receiving sensor data indicating presence of the wearable tracking device.

18. The apparatus of claim 17, the instructions further executable by the processor to:

correlate an identification code of the wearable tracking device with a value stored in the database, the value indicating a person authorized to possess the wearable tracking device, wherein receiving the first identity confirmation is based at least in part on the correlating.

19. The apparatus of claim 16, the instructions further executable by the processor to:

receive picture or video content from the camera, wherein the picture or video content comprises an image of at least one of the wearable tracking device, the individual possessing the wearable tracking device, or at least a portion of the premises, wherein receiving, from the camera, the second identity confirmation is based at least in part on the received picture or video content.

20. A non-transitory computer-readable medium storing computer-executable code for a security and automation system, the code executable by a processor to:

detect a wearable tracking device at a premises;

receive, from a database, a first identity confirmation associated with the wearable tracking device based at least in part on the detecting;

receive, from a camera, a second identity confirmation of an individual possessing the wearable tracking device at the premises;

validate an identity of the individual possessing the wearable tracking device and a location of the individual within a monitored area based at least in part on the first identity confirmation and the second identity confirmation;

determine a risk level associated with the monitored area based at least in part on the identity of the individual possessing the wearable tracking device and a determination that the location of the individual is within the monitored area;

determine a presence of an additional wearable tracking device within a range of the monitored area based at least in part on a third identity confirmation received from the database and a fourth identity confirmation received from the camera;

determine to transmit a notification to an individual associated with the security and automation system based at least in part on the presence of the additional wearable tracking device within the range of the monitored area and that the additional wearable tracking device is within the monitored area for a period satisfying a threshold; and initiate a function of the security and automation system based at least in part on the risk level associated with the monitored area, the presence of the additional wearable tracking device, and the individual being located within the monitored area for a duration greater than a pre-configured threshold.

* * * * *